United States Patent [19]

Osada

[11] 4,265,065

[45] May 5, 1981

[54] SILO

[76] Inventor: Shiroyoshi Osada, No. 5-36, Sakura 2-chome, Iwanuma-shi, Miyagi-ken, Japan

[21] Appl. No.: 28,827

[22] Filed: Apr. 10, 1979

[30] Foreign Application Priority Data

May 31, 1978 [JP] Japan ..... 53/74768[U]

[51] Int. Cl.[3] ..... B65D 88/26; E04H 7/22

[52] U.S. Cl. ..... 52/197; 222/460; 222/485

[58] Field of Search ..... 52/192, 197; 222/460, 222/431, 478, 485

[56] References Cited

U.S. PATENT DOCUMENTS

| | | | |
|---|---|---|---|
| 2,984,874 | 5/1961 | Traue | 52/192 |
| 3,292,324 | 12/1966 | Cole | 52/197 |
| 3,512,321 | 5/1970 | Boatner | 52/197 |
| 3,921,351 | 11/1975 | Johnson | 52/192 X |

FOREIGN PATENT DOCUMENTS

| | | | |
|---|---|---|---|
| 728368 | 12/1966 | Italy | 52/197 |

*Primary Examiner*—J. Karl Bell

*Attorney, Agent, or Firm*—Thomas R. Morrison

[57] ABSTRACT

This invention relates to a silo for passing or feeding various kinds of powders into something else. The silo comprises a storage portion positioned at the upper part thereof and two or more hoppers which diverge from a position in the silo height, wherein a vertical internal wall of the storage portion is integrally associated with a vertical internal wall of the hopper having the exhaust port. Accordingly, powders stored into the silo can fall perpendicularly along the vertical internal walls of the storage and of the hoppers, thereby being smoothly exhausted from the exhaust ports without causing any bridging phenomenon or air locking of the powders in the silo. In addition, the falling speed of the powders is accelerated.

5 Claims, 12 Drawing Figures

SILO

BACKGROUND OF THE INVENTION

The present invention relates to improvements in or relating to a silo, particularly for passing or feeding powders into something else.

A conventional funnel-type silo is provided with a small exhaust port for passing or feeding loose materials or liquids or powders into something else which pour from a wide, cone-shaped mouth, wherein a center point of the exhaust port is equal to a center point of the wide, cone-shaped mouth. For this kind of silo for storing various kinds of powders, it is very important to prevent a bridging phenomenon of powders within a hopper. To cope with such disadvantage, the following countermeasures have been so far carried out:

(1) to smooth an overall internal face of the silo including the hopper.

(2) to steepen a tapered slope of the hopper.

(3) to provide a particular hole for destructing briding, which penetrates into the storage portion inside. (In operation, the hole is sealed.)

(4) to install an agitating vane or an arch breaker within the storage portion.

(5) to enlarge the diameter of an exhaust port.

When adopting the foregoing countermeasures, installation of such a silo may be burdensome and the installation cost thereof may be expensive. In addition, none of those countermeasures is effective for solving the briding phenomenon of powders. Particularly, for a silo for storing powders, it is extremely difficult to prevent the bridging phenomenon in the hopper which hinders smooth feeding of powders from the hopper exhaust port into another device.

In order to overcome the aforementioned disadvantages of the conventional silo, the present invention has been achieved.

BRIEF SUMMARY OF THE INVENTION

Therefore, it is a general object of this invention to provide a silo for powders, comprising a storage portion and two or more hoppers which diverge from a part preferably lower than a center point of the silo height, characterized in that a vertical internal wall of the storage portion is integrally associated with a vertical internal wall of the hopper having an exhaust port.

Under the above arrangement, powders stored in the storage portion as well as in the hopper can fall perpendicularly along the vertical internal walls of the storage portion and of the hoppers, thereby being smoothly exhausted from the exhaust ports into something else without causing any bridging or air locking of powders.

It is another object of this invention to provide a silo for powders which requires small installation area and low manufacturing cost.

Other and further objects, features and advantages of this invention will appear more fully from the following description.

BRIEF DESCRIPTION OF THE ACCOMPANYING DRAWINGS

FIGS. 1*a*, 1*b* and 1*c* are a front view, a plan view and a perspective view respectively of a silo according to an embodiment this invention.

FIGS. 2*a*, 2*b* and 2*c* are a front view, a plan view and a perspective view showing another embodiment of this invention.

FIGS. 3*a*, 3*b* and 3*c* are a front view, a plan view and a perspective view showing another embodiment of this invention.

FIGS. 4*a*, 4*b* and 4*c* are a front view, a plan view and a perspective view showing another embodiment of this invention.

DETAILED DESCRIPTION OF PREFERRED EMBODIMENTS

First Embodiment

Figure 1B:
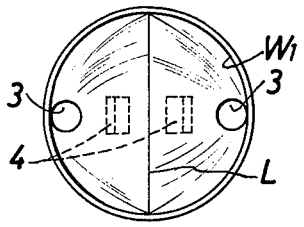
Figure 1C:
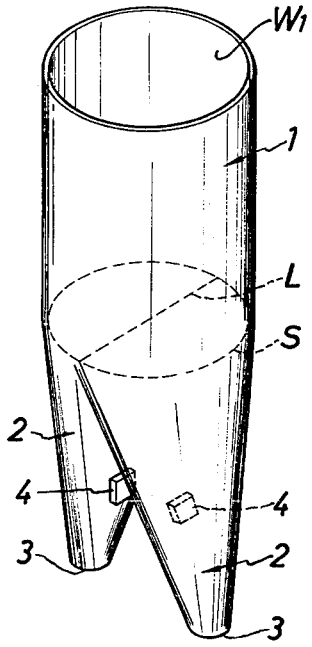
Figure 1A:
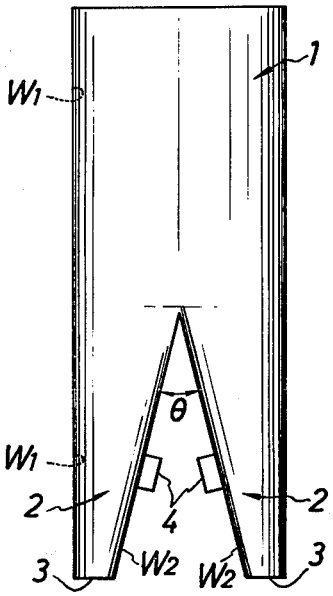

FIGS. 1*a*, 1*b* and 1*c* show the first embodiment of a silo according to this invention. The silo consists of a cylindrical storage portion 1 (or an upper part of the silo) and two hoppers 2, 2, (or a lower part thereof). The two hoppers 2, 2 diverge from a diameter L which is positioned at a part lower than a center point of the silo height. Each hopper 2 has a vertical internal wall at W1 which is integrally associated with a vertical internal wall W1 of the cylindrical storage portion 1. Further, each hopper 2 has an exhaust port 3 of circular shape and a sloped wall W2 starting from a semicircle periphery S. An angle $\theta$ between the two sloped walls W2, W2 can be enlarged over 60°. Under the above arrangement, powders are poured into the storage portion 1 from an upper mouth thereof and stored therein. When the stored powders are fed into something else from the exhaust port 3 by opening them, they can fall perpendicularly along the vertical internal wall W1 of the storage portion 1 as well as of the hoppers 2, 2, thereby being smoothly exhausted from the exhaust ports 3, 3 without causing any bridging of or any air locking of powders in the silo.

In order to achieve completely smooth feeding of the powders, two vibrators 4, 4 for vibrating the hoppers 2, 2 may be mounted on the slope wall W2, W2.

Second Embodiment

Figure 2B:
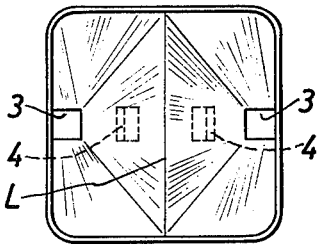
Figure 2C:
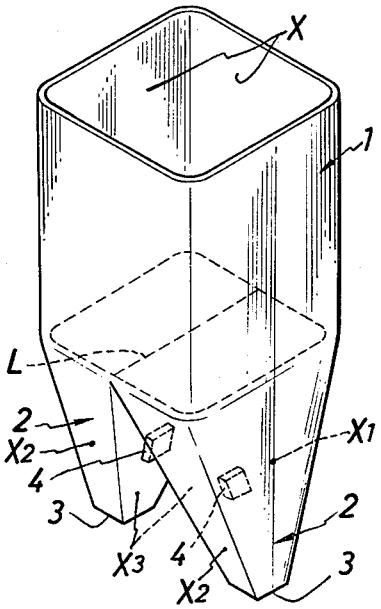
Figure 2A:
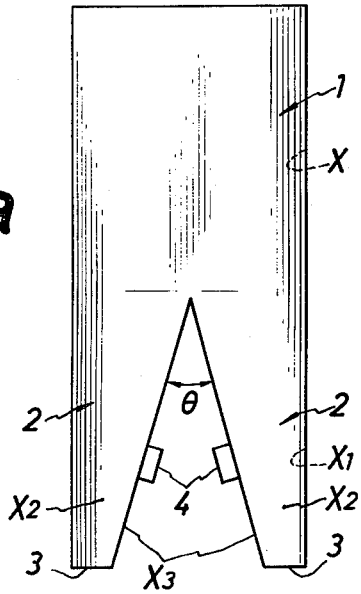

FIGS. 2*a*, 2*b* and 2*c* show the second embodiment of a silo according to this invention. The silo consists of a rectangular storage portion 1 and two hoppers 2, 2,. The two hoppers 2, 2 are also diverged from the diameter L which is positioned at a lower part than a center point of the silo height. Each hopper 2 has an exhaust port 3 of a square or rectangular shape, whereby a vertical wall X1 integrally associated with a vertical wall X of the storage portion 1, two sloped walls X2, X2 and a sloped back wall X3 are terminated at the exhaust port 3. The rectangular storage portion 1 has four walls X, each having the same area.

An angle $\theta$ between the two sloped back walls X3, X3 is enlarged over 60° like in the first example.

Under the above arrangement, when the powders stored in the silo are fed into something else from the exhaust ports 3, 3 by opening them, they can fall perpendicularly along the vertical walls X of the storage 5 as well as along the vertical wall X1, X1 of the hoppers 2, 2, thereby being smoothly exhausted from the exhaust ports 3, 3 without causing bridging or air locking of powders in the silo.

Further, two vibrators 4, 4 may be mounted on the back walls X3, X3 in order to achieve a complete feeding of the powders.

Third Embodiment

Figure 3B:
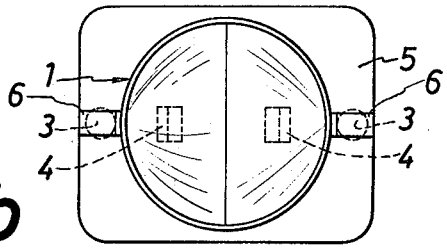
Figure 3A:
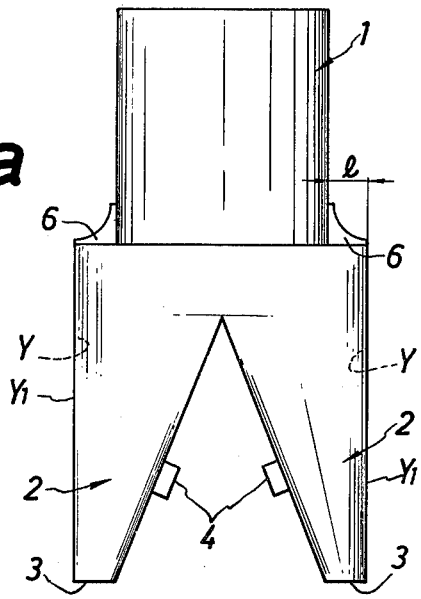
Figure 3C:
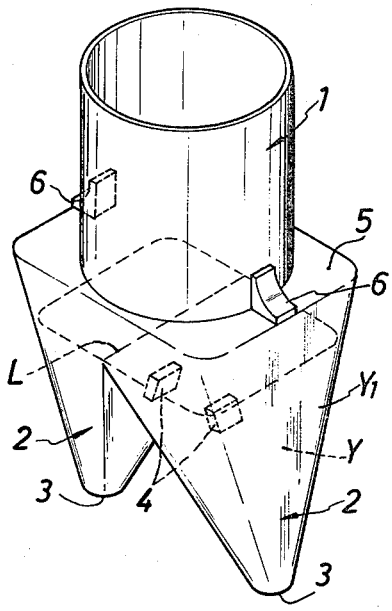

FIGS. 3*a*, 3*b* and 3*c* show the third embodiment of a silo according to this invention. In this embodiment, the cylindrical storage portion of the first example is mounted on a top surface 5 of two hoppers 2, 2. The two hoppers 2, 2 are diverged from a center line L of a square-type top surface whose respective corner is of a round shape, and have two exhaust ports 3, 3 of a circular shape. As shown obviously in FIGS. 3*a*, 3*c*, each hopper 2 forms a vertical wall at position Y.

Unlike the first and second examples, the vertical wall Y of the hopper 2 is not integrally associated with the wall of the storage portion 1. Both the vertical wall Y of the hopper 2 and the wall of the storage portion 1 are separated from each other while keeping a slight space l. In order words, both vertical walls are positioned in parallel with each other in a perpendicular direction. Alternatively, the external wall of the storage portion 1 may be positioned so as to integrally correspond to the vertical wall Y of the hopper 2. Numeral 6 is a stopper for supporting the storage portion 1 and the hopper 2. Four corners of the hopper 2 are provided with round portions for feeding the powders smoothly into the exhaust port 3. An angle $\theta$ between the two hoppers 2, 2 can be provided over 60°.

Under the above arrangement, the powders are poured into the storage portion 1 from an upper mouth thereof and stored therein. When the stored powders are fed into something else from the exhaust ports 3 by opening them, they can fall perpendicularly along the vertical wall Y of the hopper 2 without causing bridging or air locking in the silo.

Further, two vibrators 4, 4 may be mounted on two back walls opposing the wall Y1 of the hopper 2. The third example is in combination of the first and second examples.

Fourth Embodiment

Figure 4B:
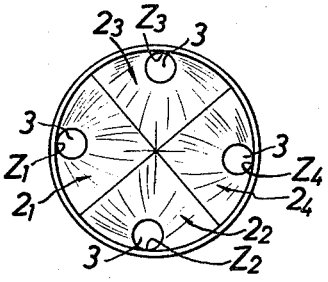
Figure 4A:
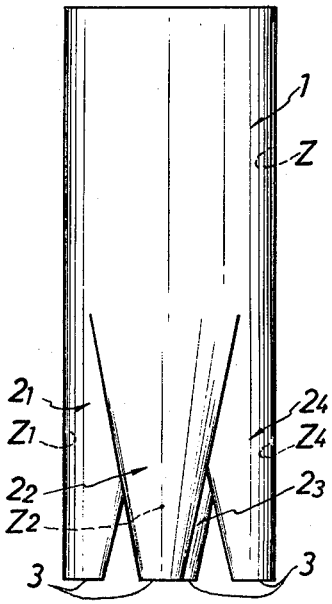
Figure 4C:
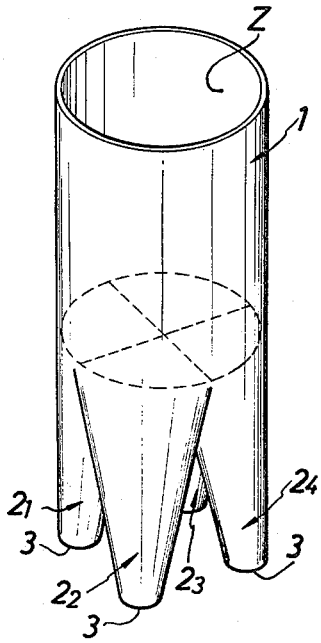

FIGS. 4*a*, 4*b* and 4*c* show the fourth example of a silo according to this invention. It improves furthermore the first example. As shown in FIGS. 4*a*, 4*b*, 4*c*, the silo has four hoppers 21, 22, 23, 24, each of which has the same shape and same area. A vertical internal wall Z of the storage portion 1 is integrally associated with four vertical internal walls Z1, Z2, Z3 and Z4 of the hoppers 21, 22, 23, 24 respectively. The two hoppers 21 and 24 as well as the two hoppers 22, 23 are opposing to each other, and diverged from each other at the angle $\theta$. The angle $\theta$ can be enlarged over 60°. Each hopper has the exhaust port 3 of circular shape.

Under the above arrangement, the stored powders can fall perpendicularly along the wall of the storage as well as along the four vertical internal walls Z1, Z2, Z3 and Z4 of the hoppers 21, 22, 23 and 24 respectively, and are exhausted smoothly from the four exhaust ports 3 without causing air bridging or air locking of powders in the silo.

In any one of the above four embodiments, powders are falling perpendicularly along the vertical wall of the storage as well as along the vertical internal walls of two or more hoppers. Accordingly, the falling speed of the powders is accelerated greatly. Needless to say, the powders are also falling along the sloped walls of those hoppers. Accordingly, the silo according to this invention has overcome the bridging of powders which occurs often in a conventional funnel-shaped silo.

Further, the structure of the silo of this invention is simple, so that the production cost is inexpensive. In addition, it is very easy to substitute this silo for the conventional one without any particular arrangement. And, if necessary, a preferred number of vibrators for vibrating hoppers can be mounted on the back walls of the hoppers.

It is to be understood that the form of this invention herein shown and described is to be taken as a preferred example of the same and that various changes in the shape, size and arrangement of parts may be resorted to without departing from the spirt of this invention or the scope of the subjoined claims.

What is claimed is:

1. A silo for storing and discharging powder comprising a storage portion having a vertical perimeter wall, said vertical perimeter wall having a vertical inside surface, at least first and second hoppers below said storage portion contiguous to the bottom perimeter of said perimeter wall, a first exhaust port at the bottom of said first hopper, a second exhaust port at the bottom of said second hopper, a first vertical internal wall portion in said first hopper forming an integral continuation of said vertical inside surface of said storage portion, said first vertical internal wall portion ending contiguous to at least a first point on said first exhaust port, a second vertical internal wall portion in said second hopper forming an integral continuation of said vertical inside surface of said storage portion, said second vertical internal wall portion ending contiguous to at least a second point on said second exhaust port, said at least first and second exhaust ports being symmetrically disposed about a vertical axis of said storage portion, said first and second exhaust ports being disposed radially inward of said first and second points with respect to said vertical axis whereby at least some of said powder adjacent said vertical inside surface can fall vertically downward and be discharged through said first and second exhaust ports, the upper ends of said at least first and second hoppers dividing the cross sectional area of said storage portion into substantially equal symmetrical contiguous portions each of which is contiguous to said vertical axis, said first and second exhaust ports having a total area substantially less than said cross sectional area of said storage portion, and each of said at least first and second hoppers tapering smoothly to its respective exhaust port.

2. A silo for storing and discharging powder according to claim 1 wherein said storage portion is cylindrical and said first and second exhaust ports are circular.

3. A silo for storing and discharging powder according to claim 1 wherein said storage portion has a generally rectangular cross section with rounded corners and said first and second exhaust ports are rectangular.

4. A silo for storing and discharging powder according to claim 1 further comprising an upper storage portion above the first mentioned storage portion, said upper storage portion having a cross sectional area which is different from the cross sectional area of the first mentioned storage portion.

5. A silo for storing and discharging powder according to claim 1 further comprising at least one vibrator on at least one of said first and second hoppers.

* * * * *